US007863817B2

(12) United States Patent
Kim et al.

(10) Patent No.: US 7,863,817 B2
(45) Date of Patent: Jan. 4, 2011

(54) LAMP ELECTRODE AND METHOD OF FABRICATING THE SAME

(75) Inventors: Jae Bum Kim, Daegu (KR); Young Mi Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 695 days.

(21) Appl. No.: 11/299,659

(22) Filed: Dec. 13, 2005

(65) Prior Publication Data

US 2006/0214555 A1 Sep. 28, 2006

(30) Foreign Application Priority Data

Mar. 22, 2005 (KR) ..... 10-2005-0023858

(51) Int. Cl.
*H01J 65/00* (2006.01)
*H01J 61/06* (2006.01)

(52) U.S. Cl. ..... 313/607; 313/234; 313/491

(58) Field of Classification Search ..... 313/607, 313/491, 493, 234
See application file for complete search history.

(56) References Cited

U.S. PATENT DOCUMENTS

| | | | | |
|---|---|---|---|---|
| 5,013,966 | A * | 5/1991 | Saikatsu et al. | 313/493 |
| 2003/0196732 | A1 * | 10/2003 | Carey et al. | 148/537 |
| 2004/0222743 | A1 * | 11/2004 | Takagi et al. | 313/634 |
| 2005/0189879 | A1 * | 9/2005 | Minamoto et al. | 313/607 |
| 2005/0218783 | A1 * | 10/2005 | Kim et al. | 313/491 |
| 2006/0087240 | A1 * | 4/2006 | Nam et al. | 313/607 |

* cited by examiner

*Primary Examiner*—Karabi Guharay
(74) *Attorney, Agent, or Firm*—McKenna Long & Aldridge LLP

(57) ABSTRACT

A lamp electrode includes a sealed tube for generating light when powered by an external power supply and a pair of electrodes formed on the ends of the sealed tube. Solder is filled into the space between each electrode and the sealed tube, and formed on the surface of the exterior surface of the electrodes. A method for forming the lamp electrode includes forming a cylindrically shaped electrode on an end of a sealed tube; maintaining a supply of solder in the liquid state; and dipping the end of the tube on which the electrode is formed into the solder.

4 Claims, 10 Drawing Sheets

LAMP ELECTRODE AND METHOD OF FABRICATING THE SAME

This application claims the benefit of Korean Patent Application No. P2005-023858, filed on Mar. 22, 2005, which is hereby incorporated by reference for all purposes as if fully set forth herein.

BACKGROUND OF THE INVENTION

1. Field of the Invention

The present invention relates to an electrode structure of a lamp, and more particularly to an electrode structure that is adaptive for easily fixing an electrode and stably implementing a soldering operation of the electrode, and a method for forming the electrode structure.

2. Discussion of the Related Art

In general, because liquid crystal display (LCD) devices are thin, low weight, and have low power consumption, they are increasingly being used as the displays of portable devices. Liquid crystal display devices are widely used as flat panel displays in office automation equipment such as laptop and desktop computers, in audio/visual equipment, and in other types of equipment.

LCD devices operate by controlling the transmittance of light beams emitted by a backlight unit through a liquid crystal display panel. The liquid crystal display panel includes a plurality of liquid crystal cells arranged into a matrix and a plurality of control switches for supplying video signals to the corresponding liquid crystal cells in order to display the desired video image on a screen.

Liquid crystal display devices are not self-luminous and require a light source or backlight to provide a visible video image. LCD backlights are classified as direct type or an edge type depending on the location of the light source or lamp relative to the LCD flat panel. In an edge type backlight, a lamp is installed near an outer part of the flat panel, and light rays from the lamp are directed over the surface of the flat panel by use of a transparent light guide. In a direct type backlight, a plurality of lamps are disposed in a plane with the light rays emitted from the lamps directly incident to the LCD flat panel.

The lamp used in the LCD backlight may be a cold cathode fluorescent light (CCFL) type as shown in FIG. 1. The CCFL lamp employs an electrode contained within the two ends of a glass tube for connection of supply power. The backlight lamp may be an external electrode fluorescent light (EEFL) type where power is supplied to a metal electrode which encompasses both ends of a glass tube of the lamp as shown in FIG. 2.

Referring to FIG. 1, a cold cathode fluorescent lamp 1 of the related art includes a glass tube 2 in which a light-emitting material is sealed; an electrode 3 formed at the ends of a glass tube 2; and an electrode line 4 which penetrates the glass tube 2 to connect to the electrode 3.

The electrode line 4 of the CCFL lamp 1 is connected to a power source to supply energy to the electrode 3. The manufacturing processes in the related art for penetrating the glass tube 2 to connect the electrode line 4 to the electrode 3 are complex and frequently produce a defective lamp. The EEFL lamp 5 shown in FIG. 2 has been proposed to avoid the need to penetrate the glass tube 2 to connect to the electrode 3

Referring to FIG. 2, an EEFL lamp 5 includes a glass tube 6 within which a light-emitting material is sealed and an electrode 7 formed in a cylindrical shape covering each end of the glass tube 6. Supplying a source of high voltage to the electrodes 7 of the EEFL lamp 5 causes the light-emitting material within the glass tube 6 to emit light.

Because the electrode 7 of the EEFL lamp 5 of the related art is external to the glass tube 6 the electrode 7 may become separated from the glass tube rendering the lamp inoperable. The electrode 7 may be attached to an end of glass tube 6 in a soldering operation. The soldering operation requires the application of a high temperature to the glass tube 6 to melt the solder. An operator performing the soldering operation may accidentally damage the glass 6 tube while applying the high temperature. If the operator applies insufficient heat or otherwise fails to properly complete the soldering operation, the electrode 7 and the glass tube 6 may become separated producing an inoperable lamp.

SUMMARY OF THE INVENTION

Accordingly, the present invention is directed to a lamp electrode and method of fabricating the same that substantially obviates one or more of the problems due to limitations and disadvantages of the related art.

An advantage of the present invention is that the electrode is easily and stably soldered to the tube.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other advantages of the invention, a lamp electrode according to an aspect of the present invention includes a sealed tube for generating light, the sealed tube powered from an external power supply; electrodes formed to cover each end part of the tube; and a solder filled into a space between the electrodes and the tube and formed on an external surface of the electrodes.

In another aspect of the invention, a method of forming an electrode includes the steps of providing a solder in a liquid state; providing an electrode formed to cover both end parts of a tube; and inserting each end part of the tube into and taking each the end part out of the solder of liquid state.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain principles of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
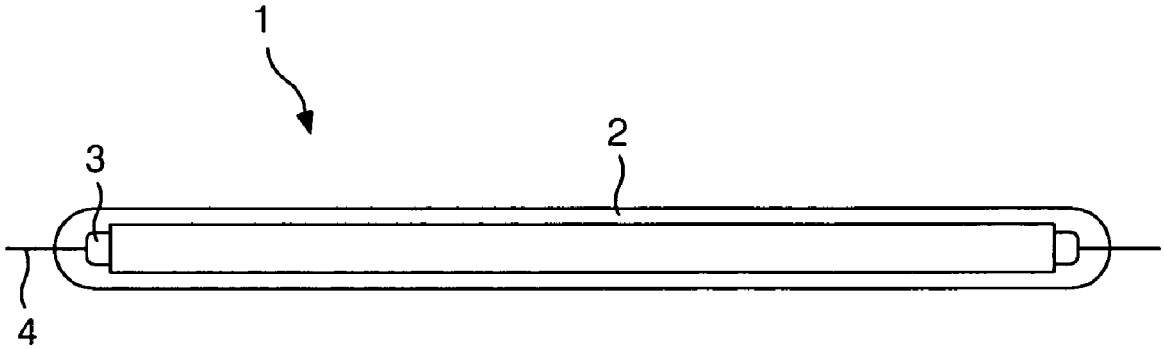
FIG. 1 RELATED ART
FIG. 1 is a schematic illustration of a cold cathode fluorescent lamp (CCFL) of the related art.
Figure 2:
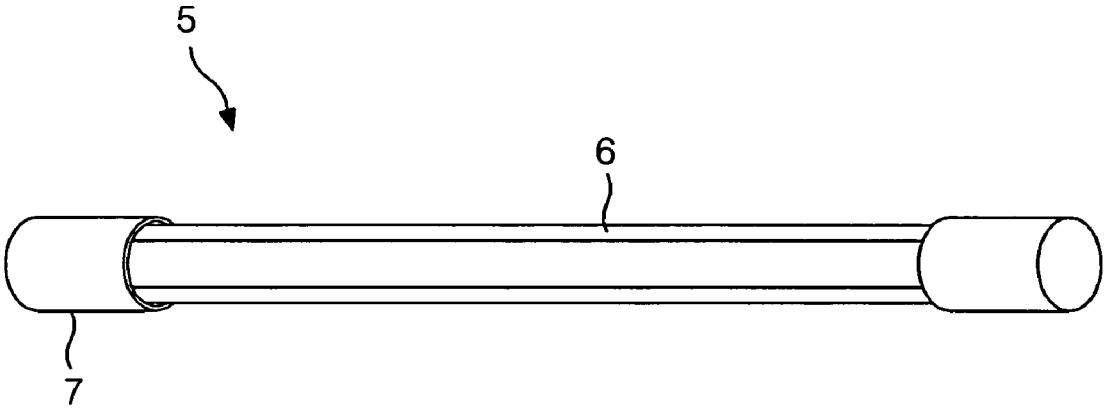
FIG. 2 RELATED ART
FIG. 2 is a perspective view of an external electrode fluorescent light (EEFL) type lamp of the related art.
Figure 3:
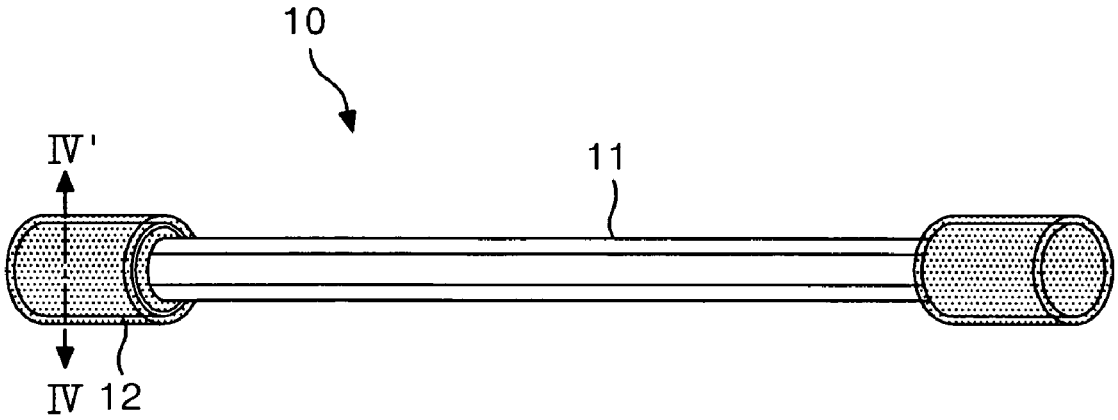
FIG. 3 is a perspective view of an EEFL lamp according to an embodiment of the present invention.
Figure 4:
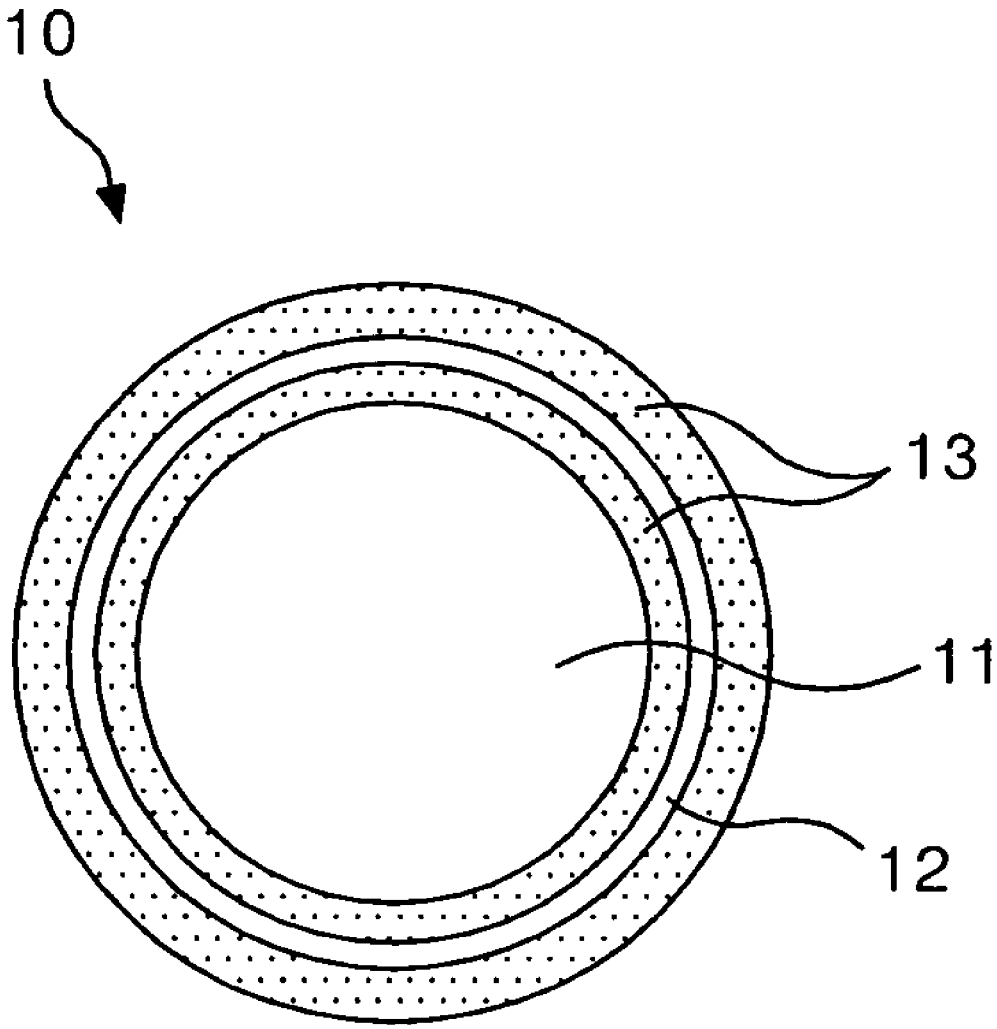
FIG. 4 is a sectional view taken along line IV-IV' of FIG. 3.

FIGS. 3 and 4 illustrate an exemplary external electrode type lamp according to an embodiment of the present invention.

Referring to FIGS. 3 and 4, an external electrode type lamp 10 includes a sealed glass tube 11. An electrode 12 is inserted over each end of the glass tube 11; and vacant space between the electrodes 12 and the glass tube 11 is filled with solder which fixes the electrodes 12 to the glass tube 11.

The interior cavity of the glass tube 11 is filled with an inert gas, and a fluorescent substance is spread over the inner wall of the glass tube 11. When electrical energy is applied to the electrodes 12 at the ends of the glass tube 11, electrons are emitted from each electrode 12. The electrons collide with the atoms of the inert gas within the glass tube and each collision releases one or more electrons from the atoms of the inert gas, thereby increasing the population of free electrons within the glass tube 11 by geometric progression. The free electrons produce a current flow of moving electrons within of the glass tube 11. The moving electrons collide with the atoms of the inert gas and excite the inert gas atoms causing the gas atoms to emit ultraviolet radiation. The ultraviolet radiation strikes the fluorescent substance spread over the inner wall of the glass tube 11, causing the fluorescent substance to emit visible light.

Each electrode 12 is of the form of a cylindrical cap adapted to enclose an end of the glass tube 11 within the interior surface of the cap. The interior surface of the electrode 12 has a diameter similar to the diameter of the glass tube 11 allowing the glass tube to be inserted with the interior of the electrode 12.

The solder 13 is applied to the interior and exterior surfaces of the electrode 12 and to the exterior surface of the both end parts of the glass tube 11, thereby electrically connecting the glass tube 11 to the electrode 12 and fixing the electrode 12 to the glass tube 11.

A method of forming the electrode according to the present invention will be described in detail with reference to FIGS. 5A, 5B, and 5C.

Figure 5A:
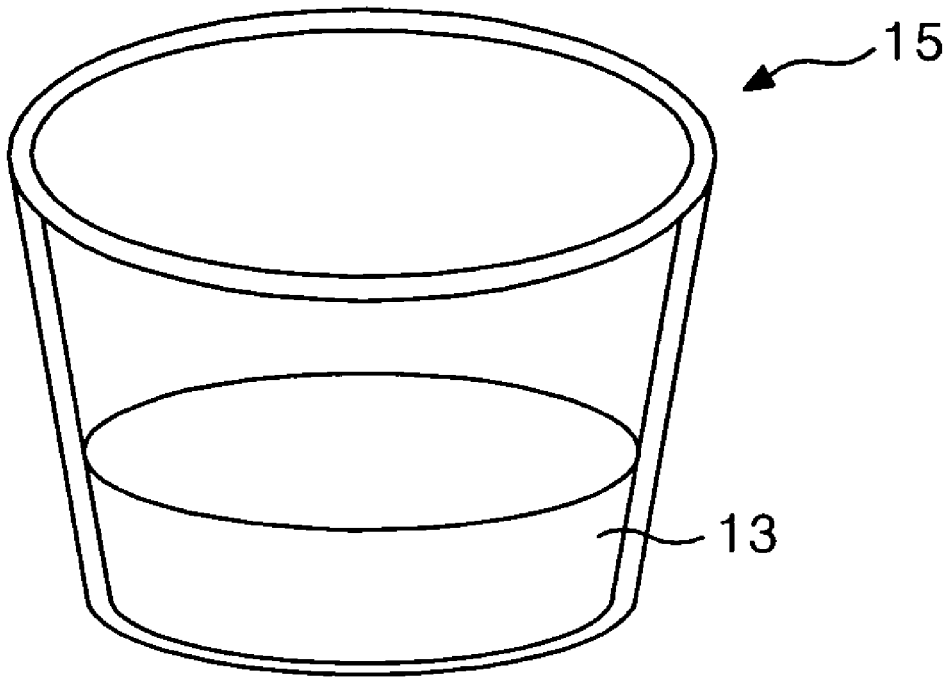
FIGS. 5A, 5B, and 5C are perspective views illustrating a method for forming a lamp electrode according to an embodiment of the present invention.

Referring first to FIG. 5A, a dipping tank 15 filled with solder 13 is provided. The solder 13 in the dipping tank is melted into a liquid form allowing the solder 13 to adhere to a target coming into contact with the solder. To melt the solder, heat is applied to the dipping tank 15 to heat the solder 13 contained therein. The solder 13 attains a liquid state as it is heated to a temperature above a specified melting point temperature.

The solder 13 may comprise lead (Pb). Solders not including lead may be used to avoid environmental problems associated with lead. A solder comprising at least any one of tin (Sn), zinc (Zn) and aluminum (Al) where no lead is included may be used. A solder comprising an alloy of two or more of tin (Sn), zinc (Zn) and aluminum (Al) may also be used. The solder 13 has a melting point within a temperature range of about 200° C. to about 300° C. The temperature of the dipping tank is controlled within the range of about 200° C. to about 300° C. to maintain the solder 13 in a liquid state.

Figure 5B:
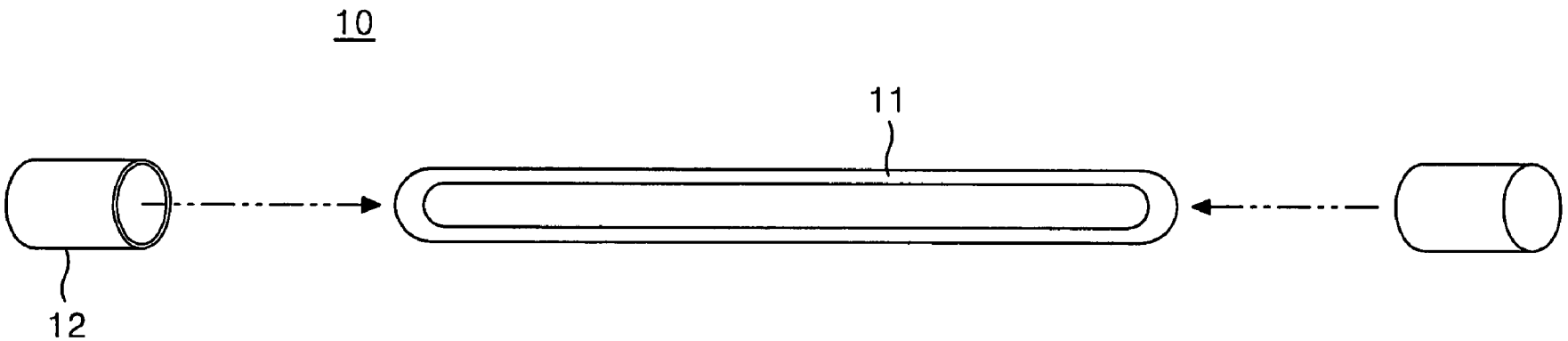

FIG. 5B further illustrates the process of forming the electrode 12. The electrode is a cylindrically shaped cap, the front and rear surfaces of which are pierced. The electrode 12 is formed over an end part of the sealed glass tube 11. The glass tube 11 contains an inert gas within the interior cavity of the glass tube 11. The surface of the interior wall of the glass tube 11 is covered with a fluorescent material spread over the interior wall of the glass tube 11.

The electrode 12 is formed of a metal material such as copper, aluminum, or other material having a high electrical conductivity. The electrode 12 is formed over an end part of the glass tube 11 so that the end of the electrode 12 approximately coincides with the end part of the glass tube 11.

Figure 5C:
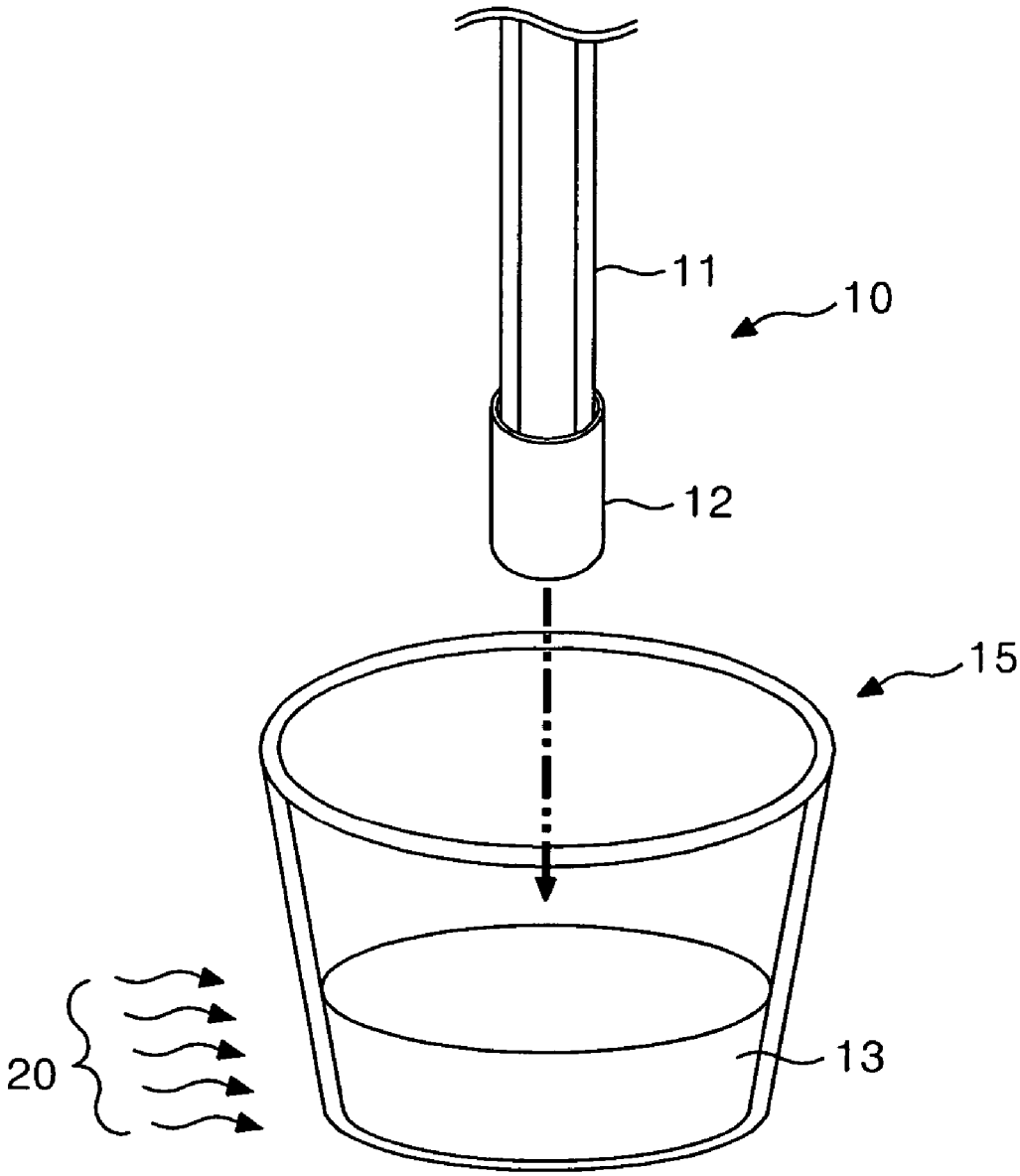

As illustrated in FIG. 5C, the end part of the glass tube 11 onto which an electrode 12 has been formed is then dipped into the liquid solder 13 contained in the dipping tank 15.

When the electrode is dipped into the liquid solder 13, a portion of the liquid solder 13 permeates the vacant space between the electrode 12 and the glass tube 11. In order to produce the desired shape of hardened solder, the electrode and the end part of the glass tube are inserted into the liquid solder 13 during an inserting time of about 10 to about 14 seconds and the electrode and glass tube end part are withdrawn from the solder during a taking out time of about 8 to about 10 seconds. The inserting time is the time period between first contact of an electrode 12 with the solder 13 and the point where the electrode 12 is fully inserted within the solder. The taking out time is period between the time when the electrode is fully inserted in the solder, and the time when the electrode 13 is fully withdrawn from the solder 13. The inserting and taking out times can be varied in accordance with the length of the electrode 12. The glass tube 11 may be dipped into the solder 13 only to the depth necessary to fully immerse the electrode 12. Limiting the insertion of the glass tube to the extent necessary to immerse the electrode prevents solder from hardening on the glass tube above the electrode. Hardened solder formed on the glass tube at a point above the electrode would block the transmission of generated light from the end of the glass tube.

To facilitate the permeation of solder between the electrode 12 and the glass tube 11, supersonic vibrations 20 may be transmitted into the solder 13 during the time when the end part of the glass tube 11 and the electrode 12 are dipped into the solder 13 in the dipping tank. Preferably the supersonic vibrations 20 have a frequency of about 18 to about 21 KHz.

Figure 6:
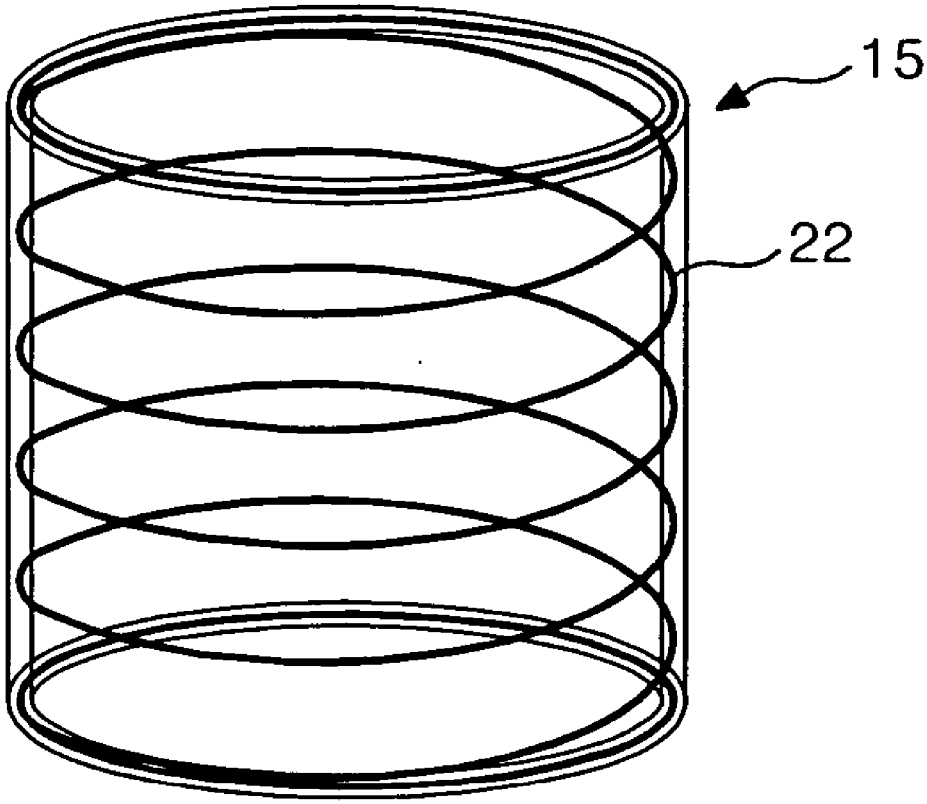
FIG. 6 is a perspective view illustrating details of a dipping tank according to an embodiment of the present invention.

A dipping tank 15 for maintaining solder in the required temperature range while forming the electrode is shown in FIG. 6. The dipping tank is formed from a ceramic material and includes a resistive wire heating element 22. By applying an electrical source of supply to the wire heating element 22, the temperature within the dipping tank 15 may be maintained and controlled.

Figure 7:
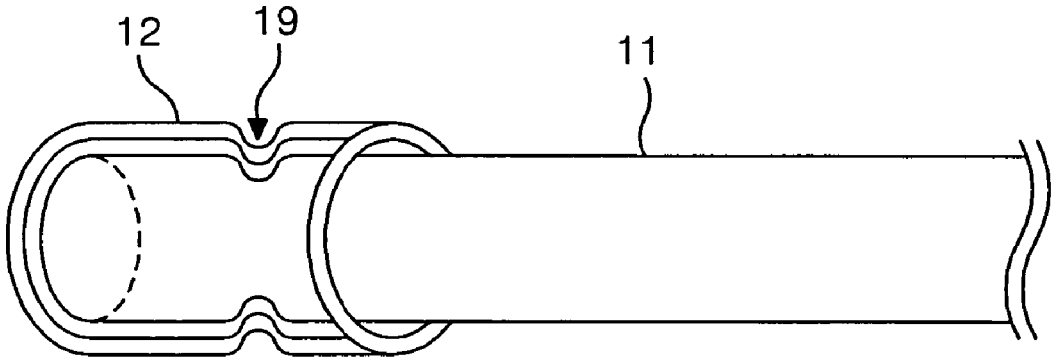
FIG. 7 is a perspective view of an electrode and glass tube according to an embodiment of the invention.

Another embodiment of the electrode forming method of an external electrode type lamp according to the embodiment of the present invention is illustrated in FIG. 7. The glass tube 11 is fabricated with a groove 19 near each of the end parts of the glass tube 11. After an electrode has been formed over the end part of the glass tube 11, the electrode is temporarily fixed to the tube by forming the electrode into the groove 19 in the glass tube by a method such as compressing or crimping.

Figure 8:
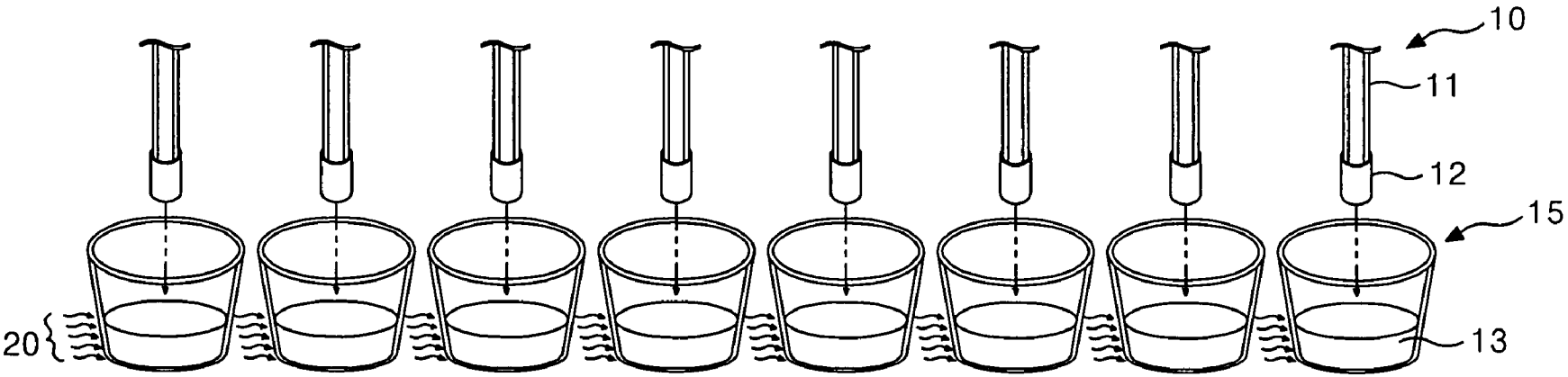
FIG. 8 is a perspective view illustrating a method of forming a plurality of electrodes.

An electrode forming method of the external electrode type lamp according to an embodiment of the present invention and providing improved productivity is illustrated in FIG. 8. A plurality of dipping tanks 15 and a plurality of glass tubes 11 are provided. Each dipping tank is filled with solder 13. Each dipping tank is formed of ceramic and includes a resistive wire heating element. After each of the dipping tanks 15 are filled with solder, electrical power is supplied to each heating element to maintain the solder 13 in a liquid state in each dipping tank. An electrode is formed onto an end part of each glass tube, and the solder 13 is formed between each glass tube 11 and each electrode 12 and on the outside surface of each electrode 12 by dipping each glass tube 11 into the solder 13 in a dipping tank in a uniform soldering operation.

As described above, the lamp electrode and the lamp electrode forming method according to the embodiment of the present invention fills the solder into the vacant space between the electrode and the glass tube. Filling the vacant space with solder prevents the formation of a parasitic capacitance caused by a vacuum state between the electrode and the glass tube, allows the smooth application of power through the solder to improve the response speed of the lamp, and integrates the electrode with the glass tube to prevent the electrode from breaking away from the glass tube, thereby minimizing the production of defective lamps.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A lamp electrode, comprising:

a sealed tube for generating light when powered by an external power supply;

a pair of electrodes, each electrode of the pair formed to cover an end part of the tube;

and a solder filled into a vacant space between each electrode and the tube and formed on a whole external surface of each electrode for electrically connecting the tube to the electrodes and fixing the electrode to the tube, wherein the each electrode is a cylindrical cap of which the front surface and the rear surface are pierced and is formed over an end part of the sealed tube to cover all the end part of the sealed tube, wherein the end of the each electrode coincides with the end part of the sealed tube, wherein the each electrode has a diameter similar to the diameter of the sealed tube allowing the sealed tube to be inserted with the interior of the each electrode, wherein the solder is applied to the interior and exterior surfaces of the each electrode and to the exterior surface of the both end parts of the tube and the solder includes lead, wherein the solder is formed by inserting the each electrode formed on the end part of the tube in a dipping tank filled with solder melted into a liquid form, wherein the solder prevents the each electrode separating from the end parts of the tube, wherein the tube comprises a groove at an end part of the tube and the electrode formed at the end part of the tube is formed into the groove, wherein the electrode and the end of the tube are inserted into the dipping tank during the inserting time of about 10 to about 14 seconds and the electrode and tube end part are withdrawn from the solder during a taking out time of about 8 to about 10 seconds, wherein the solder filled onto the vacant space between the electrode and the tube prevents the formation of a parasitic capacitance caused by a vacuum state between the electrode and the tube.

2. The lamp electrode according to claim 1, wherein the solder includes at least one of tin, zinc and aluminum.

3. The lamp electrode according to claim 1, wherein the solder includes at least two of tin, zinc and aluminum.

4. The lamp electrode according to claim 1, wherein a melting point of the solder is in a temperature range of about 200° C. to about 300° C.

* * * * *